US008172659B2

(12) United States Patent
Agam

(10) Patent No.: US 8,172,659 B2
(45) Date of Patent: May 8, 2012

(54) ELECTRONIC GAME THAT IS NOT LIMITED IN THE NUMBER OF PLAYERS OR LENGTH OF PLAY

(76) Inventor: Nitza Agam, Daly City, CA (US)

( * ) Notice: Subject to any disclaimer, the term of this patent is extended or adjusted under 35 U.S.C. 154(b) by 382 days.

(21) Appl. No.: 12/541,473

(22) Filed: Aug. 14, 2009

(65) Prior Publication Data

US 2011/0039609 A1 Feb. 17, 2011

(51) Int. Cl.
*A63F 9/24* (2006.01)

(52) U.S. Cl. ..... 463/9; 463/42

(58) Field of Classification Search ..... 463/9; 273/153, 273/156, 157 R
See application file for complete search history.

(56) References Cited

U.S. PATENT DOCUMENTS

| | | | | | |
|---|---|---|---|---|---|
| 3,010,723 | A | * | 11/1961 | Moss | 273/157 R |
| 3,558,136 | A | * | 1/1971 | McFarland | 273/282.1 |
| 3,865,368 | A | | 2/1975 | Grazebrook | |
| 4,219,194 | A | * | 8/1980 | Powers | 273/157 R |
| D311,556 | S | * | 10/1990 | Popek et al. | D21/470 |
| 5,062,637 | A | * | 11/1991 | Bianchi | 273/157 R |
| 5,265,888 | A | * | 11/1993 | Yamamoto et al. | 463/10 |
| 5,584,763 | A | | 12/1996 | Kelly et al. | |
| 5,833,536 | A | | 11/1998 | Davids et al. | |
| 5,947,820 | A | | 9/1999 | Morro et al. | |
| 6,425,581 | B1 | * | 7/2002 | Barrett | 273/157 R |
| 7,179,166 | B1 | | 2/2007 | Abbott | |
| 2002/0096828 | A1 | * | 7/2002 | Osman | 273/272 |
| 2004/0090009 | A1 | * | 5/2004 | Mortimer | 273/299 |
| 2005/0006845 | A1 | * | 1/2005 | Hardie | 273/292 |

* cited by examiner

*Primary Examiner* — Xuan Thai
*Assistant Examiner* — Michael Grant
(74) *Attorney, Agent, or Firm* — F. Rhett Brockington

(57) ABSTRACT

The invention is an electronic game that can have an unlimited number of players and length of play, where in one variation the game includes an electronic scratch card that stipulates either an amount of g-money or a partial electronic image piece that is a member of a set of pieces. A complete set of pieces can be assembled into a unitary electronic image. A player, on joining the game, is issued a set of electronic scratch cards that are an incomplete set of pieces and an amount of g-money. Each player has an individual electronic game board that provides a visualization of the scratch cards and the actions of the player. The players race to assemble the pieces into the unitary image by compiling the issued pieces and acquiring the missing image pieces. The missing pieces are acquired by trading or buying them from the other players. The winner of the game assembles the unitary image.

26 Claims, No Drawings

ELECTRONIC GAME THAT IS NOT LIMITED IN THE NUMBER OF PLAYERS OR LENGTH OF PLAY

FIELD OF THE INVENTION

The invention relates to a game, and more particularly to an electronic game that is not limited in the number of players or length of play.

BACKGROUND OF THE INVENTION

Thomas S. Abbott in his U.S. Pat. No. 7,179,166 provides a background for the evolution of games. Various games, and devices to implement those games, have been known for centuries. Some games involve highly specialized physical skills where a player pits himself on a common playing ground against other players. Examples of this type of game would be golf or bowling. In other games, players play each other with usually the more skillful prevailing. Games like racket ball or tennis are examples of this type of game. Other games where players are pitted against each other involve almost entirely mental skills developed through playing of the game. Examples of this would be chess or checkers. Other games where players are pitted against each other introduce an element of chance, usually, through some kind of random number generator-like device. Examples of this might be a poker game or bridge.

On the other hand, some games have been adopted to be used in casino-like gambling settings. Here, ordinarily, randomness plays a much larger role than does the skill of the player. Also, one ordinarily plays the house as opposed to the other players. For many years, this type of gambling was illegal in most states. However, within the last two decades, the spread of casino-like gambling, where the house bankrolls the games and pays the players, has become common and widespread, with many states legalizing certain types of gambling.

For this type of gambling and the gaming devices which are used for this type of gambling, the regulatory climate is very complex. There are federal laws that relate to gaming devices and interstate gambling. Moreover, each state has its own set of gambling laws and frequently within the state there may be jurisdictions that are outside of those laws or at least are not strictly bound by those laws (i.e., Indian reservations). Thus, there are some jurisdictions, like Nevada, where virtually any type of gambling device is allowed although the gambling industry is closely regulated. There are other states, like North Carolina, where very few, if any, gambling devices are permitted and where pay offs, even on skill-based games, are strictly limited.

Traditionally, games were played mechanically with a deck of cards, with a roulette wheel, with a pair of dice, with a wheel of fortune or keno wheel, or the like. The random outcome of the gaming device resulted from the shuffle of the cards, the roll of the dice, or so on. However, with the advent of electronic computers and compact central processing units, it has been possible to play games using electronically generated cards, dice, reels, wheels, and the like. The electronic control of the indicia of the game allows the operator of the game ordinarily to completely control the outcome of the game.

States that do not allow gambling devices or "gaming" devices where there can be a large money pay out may, nevertheless, allow coin operated devices where a player may receive a strictly limited reward oftentimes in various kinds of merchandise. These games are sometimes called "redemption" devices. For example, in state fairs or carnivals where one throws a baseball to knock dolls off a shelf or uses a rifle to break clay pigeons and, if successful, one is rewarded with a teddy bear or some similar prize of relatively low value. This is usually permitted in states that do not allow any other types of gaming or gambling devices. This type of game is also seen in video arcade settings where one may win credits that can be applied toward free play of other games or even small prizes, again, like teddy bears, other stuffed animals, or the like. Usually, in redemption games, some element of skill is required to be successful.

Grazebrook in U.S. Pat. No. 3,865,368 discloses an electronic version of the children's game of "Snap". The object of the "Snap" game is to be the first of two players to voice the term "snap" when, from a random stack of cards that each player has, a player turns over matching cards. The Grazebrook '368 patent provides that either two individuals may play against each other or an individual may play against the machine where the machine's response is controlled by a variable time delayed circuit. Morrow et al., U.S. Pat. No. 5,947,820, discloses a computer implemented electronic game that involves completion of a puzzle by the use of simulated slot machine reel. Davids et al., U.S. Pat. No. 5,833,536, discloses a game machine with a video type display that is controlled by a microprocessor or CPU. The processor uses a program to generate images of playing cards. A player uses an input device to select a moving card and direct its movement toward a selected card position and a selected one of the card hands locations. If the player does not select a card in time, it is automatically placed on one of the card hand locations by the machine on a random basis. Kelly et al., U.S. Pat. No. 5,584,763, discloses a pointer that rotates on a display face. Control mechanisms allow a player to stop and start rotation of the pointer. A game score is determined based on where the pointer stops on the game face.

A commonality among traditional games is that the game usually has a limited number of players. Board games have one winner and finite beginning and end.

SUMMARY OF THE INVENTION

The invention is an electronic game that in one variation is not limited in the number of players or length of play, where the game can include elements of skill and strategy, commitment (financial and/or time), luck (randomized events that influence outcome of the game), competitiveness (updated tracking of estimated progress of players), and interpersonal interaction (bargaining with other players). The game provides an engrossing entertaining environment that can also be utilized as an educational platform for teaching a variety of subjects, where the educational platform utilizes gamesmanship to make an arcane subject more interesting, and as an informational platform for disseminating knowledge about various products and services. The informational platform can be provided as a subtext of the game, where the information can be provided on a subliminal level. The game provides a new venue for sponsorship, where new and existing products and services are presented in an entertaining way. A sponsor is one or more entities working in concert with a facilitator to host the game.

The game is played in a media where visual communication is possible, such as a group of players in communication over the Internet through a computer or cell phone, a group of players communicating over telephones and having access to either the Internet or a television, or a combination thereof. The game can be also played within the framework of a video game, such as "Final Fantasy Origins Final Fantasy I & II Remastered Editions"™; played as a component of a massively multiplayer online game such as "Legend of Empires"™; or played as an application on a portal, such as Facebook™, where a group of friends gravitate and cooperate.

DETAILED DESCRIPTION OF THE INVENTION

The invention is an electronic game where the players have individual game boards, and game is not limited in the number of players or length of play. An aspect of the invention is that players can join the game at substantially anytime, and still have a chance of winning the game or some other prize.

Another aspect of the invention is that virtually any number of players can play at one time. In one variation, the game is started, and continues as players are added or lost until the there are no more possible winners. The sponsor, through the facilitator, can adjust the game, to either extend the game by generating more possible winners, or closeout the game, when sponsorship for the game is concluded. The game is typically structured to have a plurality of winning players, and structured where a player can have a plurality of winnings.

The game includes a set of partial electronic image pieces, that when positioned form a unitary electronic image. The unitary electronic image typically provides information about a product or a service. The unitary electronic image may be a representation of the sponsor's winning prize, where players assemble/build the unitary electronic image with the image pieces to win the prize. Typically, each partial image piece has a unique identifier with an associated list of electronic descriptors, where the electronic descriptors are maintained by the facilitator to validate that the partial image piece is not a counterfeit piece. The list of electronic descriptors typically includes a position, an orientation, a location status, a visibility status, and a par value.

The game includes a currency for the game (i.e. g-money), which can be used to purchase partial image pieces from other players and under certain circumstances from the facilitator or directly from the sponsor. The g-money, like the partial image pieces, has an associated list of electronic descriptors, where the electronic descriptors are maintained by the facilitator to validate that the g-money is not counterfeit. The g-money may also be used to purchase information and/or block information and other valuables. Additional g-money may be purchased using conventional transaction exchanges including credit cards, wiring money, secured payment methods like Pay-pal™, cashiers checks, traveler's checks, and the like. The sponsor can set the value of g-money, where it can be substantially any ratio to an actual currency, and whether the g-money can be exchanged for the actual currency.

Another aspect of the invention may include the use of an electronic scratch card (i.e. e-card), where the e-card is typically either a partial electronic image piece or an amount of g-money. The e-card provides a method of simultaneously distributing the partial electronic image pieces and the g-money. The e-card itself can include creative data, such as an image that is entertaining, informative or educational. The e-card can have a masking surface, that must be removed, for instance by virtually scratching or peeling, to reveal whether the e-card is a partial electronic image piece or g-money. In the specification the word "scratched" is defined to mean rubbed, peeled, etched, and removed.

Another aspect of the invention may include the use of other games to determine the gaining of g-money and partial electronic image pieces. For example, g-money and partial electronic image pieces can be gained by players based on the outcome of another game. At the sponsor's discretion, the player could be offered several choices to determine how the g-money and partial electronic image pieces are gained. Examples of other games include an electronic card game, a massively multiplayer online game, an electronic chess game, and the like.

When a new player joins the game he/she is issued a randomly selected incomplete set of partial electronic image pieces and an amount of g-money, or a set of e-cards, as described above which are scratched revealing the piece or g-money. The incremental amount of g-money may also be randomly selected. The sponsor has the prerogative to include a cash prize and the like as a component of the amount of g-money, where the cash prize and the like can be more valuable than winning the game. This prerogative builds interest, excitement and luck in the game.

An existing player is encouraged to recruit new players or "friends", by rewarding the existing player with additional g-money and/or recruitment cash prizes, where the recruitment cash prize can be more valuable than winning the game. This builds the number of players, and the goal of the sponsor to expose the products and services to a larger number of people.

In order to gain a complete set of partial electronic image pieces, players need to acquire the partial image pieces that were not originally issued (i.e. as either e-cards or the incomplete set of partial electronic image pieces). There are several typical methods by which this is available. A partial list follows. Players can trade partial electronic image pieces or other valuable goods/services with other players; players can buy the image pieces by posting what piece they wish to purchase on an electronic bulletin-board; they can play the game under numerous aliases—combining information; they can play as teams; they can buy additional partial electronic image pieces or cards from the facilitator or in some cases the sponsor; and they can sell duplicate electronic image pieces to gain additional g-money to buy a partial electronic image piece that is in short supply. Also, a player can enter a game just to provide a market for their partial electronic image pieces.

The number of potential winners is limited to the number of potentially complete sets of partial electronic image pieces. A single piece or a plurality of pieces can be used to restrict the number of potential winners. The piece is typically designated a restriction piece, and it can be included in a predetermined number of the sets of partial electronic image pieces or cards. Alternatively, the restriction piece can be included at a predetermined percent of the total number of sets of partial electronic image pieces or cards that are selected. In another variation, the restriction piece is only available from the sponsor or the facilitator, either through a lottery or a transaction. In the spirit of openness and fairness to the players, the sponsor, or the facilitator at the direction of the sponsor, discloses how many restriction pieces are available, and how many have been issued. The fewer the number of restriction pieces, generally speaking, the greater the value of a restriction piece, as the player must obtain the restriction piece(s) to complete the unitary image. To keep the momentum of the game up, more restriction pieces can be released as the game progresses, thereby improving the chances that a player will be a winner, as there are more potential complete sets of partial electronic image pieces (potential winners).

An aspect to the invention is that the game can have a rolling deadline, where the deadline is determined by the level of interest in the game. So long as interest is high, the game may be continued, as it serves as a source of entertainment, information and education. Even though there may have been many winners, the game can still be played, because there need not be a time limit, there is no limit on the number of players, and the game can continue so long as there is a potentially complete set of partial electronic image pieces (potential winners). If structured on a percentage basis, then each new player can increase the probability that there still remains complete set of partial electronic image pieces (potential winners).

An interactive webpage, generated by the facilitator, typically serves as the individual player's game board. The game board may include an image of the unitary electronic image, a template for assembling the partial electronic image pieces, that when positioned form the unitary electronic image, an e-tray for storing the partial electronic image pieces that are to be positioned, and an account area that holds the g-money. In the case of e-cards, the e-cards are in a stack, and as they are scratched, they are positioned in the account area if they are money, and positioned in either the e-tray or the template if they are partial electronic image pieces.

The interactive webpage may also have a toolbar having a plurality of tools, including, a tool for moving the partial electronic image pieces, a tool to post offers to buy or barter for one or more image pieces, and a help tool. Other tools could include a cash tool for buying more g-money, an alias tool to enter the game again as a new player, an incognito tool which enables a player, for a time, to hide their identity or position in the game (how many pieces she has gained) while trading; and a spy tool that allows players to override the incognito tool, and avoid dangerous trades. A shrewd player or players may choose to ask their friends not to trade with a player close to assembling all the partial electronic image pieces.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

It is to be understood that the foregoing description and specific embodiments are merely illustrative of the best mode of the invention and the principles thereof, and that various modifications and additions may be made to the invention by those skilled in the art, without departing from the spirit and scope of this invention, which is therefore understood to be limited only by the scope of the appended claims.

What is claimed is:

1. An electronic game, said game comprises:

an electronic scratch card with a masking surface, where said electronic scratch card stipulates either an amount of e-money, said e-money serving as a currency for the game, or a partial electronic image piece that is a member of a set of partial electronic image pieces, where a complete set of partial electronic image pieces defines a unitary electronic image, where said unitary electronic image may contain information about a product or a service or other data;

where a player, that on joining the game is issued a set of electronic scratch cards, said electronic scratch cards that on being virtually scratched to determine if the electronic scratch card is e-money or one of the partial electronic image pieces; where the issued set of electronic scratch cards comprise an incomplete set of partial electronic image pieces;

where a sponsor, comprising one or more entities, provides funding for the game;

where a facilitator hosts the game;

a player's electronic game board that provides a visualization of the electronic scratch cards and the actions performed by the player, where the player's electronic game board further comprises a representation of the unitary electronic image, a template for assembling the set of partial electronic image pieces into the unitary electronic image, a stacking area for the electronic scratch cards, an e-tray for storing the partial electronic image pieces that are to be assembled, a cash area that holds the e-money, and a message area for sending/receiving messages from other players, the facilitator and the sponsor;

where the player's electronic game board enables an unlimited number of players playing the electronic game, each player having his/her own electronic game board;

where the game is played for a prize, said prize selected from the group consisting of a product, a service, a cash award and a combination thereof;

where the players race to assemble the partial electronic image pieces into the unitary image by compiling the partial electronic image pieces that were issued as electronic scratch cards on joining the game, and acquiring one or more specific partial electronic image pieces, where a specific partial electronic image piece is a partial image piece that was not originally issued that are missing;

where the specific partial electronic image piece is acquired by trading one or more partial electronic image pieces with other players and by using g-money to buy one or more specific partial electronic image pieces from other players;

where the players can gain additional e-money by selling partial electronic image pieces, recruiting a friend to become a new player, purchasing e-money from the facilitator, and other incentives as needed to maintain a desired number of players;

where, upon assembling the complete set of electronic images in the template, the player is validated to be a winner, said player receiving the prize upon validation, and returning all partial electronic image pieces to the facilitator; and where the game can continue so long as there is a potentially complete set of partial electronic image pieces and one or more players.

2. The game according to claim 1, wherein the facilitator maintains at least one potentially complete set of partial electronic image pieces by recycling the complete set of electronic images pieces in the template of the winner.

3. The game according to claim 1, wherein the player is encouraged to recruit additional friends to join the game, by rewarding an existing player with additional g-money and/or recruitment cash prizes.

4. The game according to claim 1, wherein the incomplete set of partial electronic image pieces on the electronic scratch cards are randomly selected.

5. The game according to claim 1, wherein the amount of g-money on the electronic scratch cards is issued in randomly selected increments.

6. The game according to claim 1, wherein said player's electronic game board further comprises:

a toolbar having a tool that enables the player to specify a preference and a format for viewing how many partial electronic image pieces are assembled by other players compared to the player.

7. The game according to claim 1, wherein a new player can join the game at substantially anytime, and still have a chance of winning the game or some prize.

8. The game according to claim 1, wherein said set of partial electronic image pieces further comprises:

a restriction piece, where said restriction piece is used to restrict the number of potential winners by limiting the number of complete sets of partial electronic image pieces.

9. The game according to claim 8, wherein the restriction piece is only available from the sponsor or the facilitator, either through a lottery or a transaction.

10. The game according to claim 1, wherein the player's electronic game board is an interactive webpage on the Internet.

11. The game according to claim 1, wherein the game further comprises an application on a portal.

12. The game according to claim 6, wherein the toolbar further comprises an incognito tool which enables a player, for a time, to hide their identity, their position in the game, and a spy tool that allows players to override the incognito tool.

13. The game according to claim 1, wherein the partial electronic image piece consists of electronic images selected from the group consisting of static images, moving images, images having an audible component, changing images, flashing images, images with a hyperlink, images that can expand when clicked on, images that have an associated list of properties, images with a unique identity, images that click into place in the template, images that can be rotated, 2D images, 3D images, images that are repelled when proximate to certain other images, images that are attracted when proximate to certain other images, and combinations thereof.

14. An electronic game, said game comprises:

an amount of g-money, said g-money serving as a currency for the game;

a partial electronic image piece that is a member of a set of partial electronic image pieces, where a complete set of partial electronic image pieces defines a unitary electronic image, where said unitary electronic image may contain information about a product or a service or other data;

where a player that, on joining the game, is issued g-money and an incomplete set of partial electronic image pieces;

where a sponsor, comprising one or more entities, provides funding for the game;

where a facilitator hosts the game;

a player's electronic game board that provides a visualization of the g-money, the partial electronic image pieces, and the actions performed by the player, where the player's electronic game board further comprises a representation of the unitary electronic image, a template for assembling the partial electronic image pieces into the unitary electronic image, an e-tray for storing the partial electronic image pieces that are to be assembled, a cash area that holds the g-money, and a message area for sending/receiving messages from other players, the facilitator and the sponsor;

where the player's electronic game board enables an unlimited number of players playing the electronic game, each player having has his/her own electronic game board;

where the game is played for a prize, said prize selected from the group consisting of a product, a service, a cash award, money, and a combination thereof;

where the players race to assemble the partial electronic image pieces into the unitary image by compiling the partial electronic image pieces, and acquiring one or more specific partial electronic image pieces, where a specific partial electronic image piece is a partial image piece that was not originally issued; where the specific partial electronic image pieces are acquired by trading partial electronic image pieces with other players and by using g-money to buy specific partial electronic image pieces from other players;

where the players can gain additional g-money by selling partial electronic image pieces, recruiting a friend to become a new player, purchasing g-money from the facilitator, and other incentives as needed to maintain a desired number of players; where, upon assembling the complete set of electronic images in the template, the player is validated to be a winner, said player receiving the prize upon validation, and returning all partial electronic image pieces to the facilitator; and where the game can continue so long as there is a potentially complete set of partial electronic image pieces and one or more players.

15. The game according to claim 14, wherein the player is encouraged to recruit additional friends to join the game, by rewarding an existing player with additional g-money and/or recruitment cash prizes and the like.

16. The game according to claim 14, wherein the issued incomplete set of partial electronic image pieces are randomly selected.

17. The game according to claim 14, wherein the issued amount of g-money is in randomly selected increments.

18. The game according to claim 14, wherein said player's electronic game board further comprises:

a toolbar having a tool that enables the player to specify a preference and a format for viewing how many partial electronic image pieces are assembled by other players compared to the player.

19. The game according to claim 14, wherein a new player can join the game at substantially anytime, and still have a chance of winning the game or some other prize.

20. The game according to claim 14, wherein the set of partial electronic image pieces comprises a restriction piece, where said restriction piece is used to restrict the number of potential winners by limiting the number of complete sets of partial electronic image pieces.

21. The game according to claim 20, wherein the restriction piece is only available from the sponsor or the facilitator, either through a lottery or a transaction.

22. The game according to claim 14, wherein the player's electronic game board is an interactive webpage on the Internet.

23. The game according to claim 14, wherein the game further comprises an application on a portal.

24. The game according to claim 18, wherein the toolbar further comprises an incognito tool which enables a player, for a time, to hide their identity, their position in the game, and a spy tool that allows players to override the incognito tool.

25. The game according to claim 14, wherein the partial electronic image piece consists of electronic images selected from the group consisting of static images, moving images, images having an audible component, changing images, flashing images, images with a hyperlink, images that can expand when clicked on, images that have an associated list of properties, images with a unique identity, images that click into place in the template, images that can be rotated, 2D images, 3D images, images that are repelled when proximate to certain other images, images that are attracted when proximate to certain other images, and combinations thereof.

26. The game according to claim 14, wherein the g-money can have a value that is substantially any ratio to an actual currency.

* * * * *